United States Patent [19]

Hirota et al.

[11] Patent Number: 4,593,166

[45] Date of Patent: Jun. 3, 1986

[54] DUAL ACTION PRESSURE SWITCH

[75] Inventors: Hisatoshi Hirota, Hachioji; Toyoyuki Hara, Fuchu, both of Japan

[73] Assignee: TGK Company, Limited, Hachioji, Japan

[21] Appl. No.: 699,152

[22] Filed: Feb. 6, 1985

[51] Int. Cl.[4] ..... H01H 35/34

[52] U.S. Cl. ..... 200/83 J; 200/83 P; 200/81.4

[58] Field of Search ..... 73/861.47, 717, 723, 73/744, 745; 340/626; 92/5 R, 98 R, 101; 307/118; 200/81 R, 81.4, 81.5, 82 R, 83 J, 83 P

[56] References Cited

U.S. PATENT DOCUMENTS

| | | | |
|---|---|---|---|
| 3,657,501 | 4/1972 | Hoyt | 200/81.5 |
| 4,296,287 | 10/1981 | Boulanger | 200/83 P |
| 4,400,601 | 8/1983 | Brucker | 200/81.4 |
| 4,473,729 | 9/1984 | Teng | 200/83 J |

FOREIGN PATENT DOCUMENTS 58-162534 10/1983 Japan .

*Primary Examiner*—G. P. Tolin

*Attorney, Agent, or Firm*—Wenderoth, Lind & Ponack

[57] ABSTRACT

There is provided a dual action pressure switch which comprises a casing having a pressure inlet, a diaphragm secured to and extending across the interior of the casing to define a pressure receiving chamber in the casing, a piston disposed on the side of the diaphragm opposite from the pressure receiving chamber for vertical movement subjected to pressure through the diaphragm, a holder biased to engage the piston under the force of a spring, a pair of stationary terminals having the lower ends extending downwardly beyond the lower end of the casing, a resilient disc disposed within the piston below the diaphragm for resiliently warping in one and the opposite directions and leaf springs subjected to the resilient force of the disc through a rod.

3 Claims, 9 Drawing Figures

DUAL ACTION PRESSURE SWITCH

BACKGROUND OF THE INVENTION

This invention relates to a dual action pressure switch adapted to be provided on the higher pressure side of the cooling cycle circuit for an automobile cooling device and to operate to open the electrical switching section operatively connected to the compressor for the cooling cycle circuit and interrupt the operation of the compressor when the pressure on the higher pressure side of the cooling cycle circuit rises or reduces to an abnormal value.

A variety of dual action pressure switches have been proposed and practically employed. One of the conventional dual action pressure switches is disclosed in Japanese Laid-Open Utility Model Application No. 162534/1983. The dual action pressure switch of this type generally comprises a casing including a lower casing portion 11 and an upper casing portion 32 secured to each other, said upper casing portion having a coaxial center pressure inlet 33 and a pressure receiving chamber 36 in communication with the inlet, a diaphragm 34 pinched at the periphery thereof between the lower and upper casing portions, a piston assembly disposed on the side of the diaphragm opposite from the pressure receiving chamber and including coaxial outer and inner pistons 19, 25 which move independently of each other, a holder 30 surrounding a lower portion of the inner piston, a spring 31 normally resiliently biasing the piston assembly upwardly through the holder and allowing the assembly to resiliently move upwardly and downwardly, a pair of stationary contacts 15, 16 secured to the lower casing portion, a pair of first movable contacts 21, 22 mounted on the outer piston and adapted to engage the stationary contacts subjected to pressure acting on both the outer and inner piston and a second movable contact 28 mounted on the inner piston above the holder.

The operation of the dual action pressure switch of the Japanese utility model will be now described. When the pressure within the pressure receiving chamber 36 in communication with the pressure inlet 33 becomes a value above a first set pressure ($P_1$) to push the piston assembly 19, 25 downwardly against the force of the spring 31, the first movable contacts 21, 22 engage the stationary contacts 15, 16, respectively. In this condition of the pressure switch, since the movable contacts 21, 22 have already engaged the second movable contact 28, the stationary contact 15, first movable contact 21, second movable contact 28 make an electric circuit to thereby turn the electrical switching section ON. When the pressure within the pressure receiving chamber 36 further rises to a value higher than a second set pressure ($P_2$), although pressure acting on the diaphragm 34 increases, the outer piston 19 cannot move downwardly because the outer piston is engaged by the stationary contacts 15, 16, the force which biases the diaphragm 34 downwardly acts on only the inner piston 25 to push the inner piston downwardly against the force of the spring 31 to thereby separate the second movable contact 28 from the first movable contacts 21, 22 which in turn interrupts the electrical connection between the stationary contacts 15, 16 resulting in the turning of the electrical switching section OFF. However, when the pressure within the pressure receiving chamber 36 drops to a value below the second set pressure ($P_2$), the electrical switching section turns ON immediately.

In this way, the electrical switching section repeatedly turns ON and OFF at the second set pressure ($P_2$) to cause the so-called chattering phenomenon and produce noise and at the same time, the contacts on the electrical switching section wear away prematurely to shorten the service life of the pressure switch.

SUMMARY OF THE INVENTION

Thus, the present invention has its purpose to provide a dual action pressure switch which can effectively eliminate the disadvantages inherent in the prior art dual action pressure switch referred to hereinabove.

According to the present invention, the chattering can be prevented by the provision of difference in higher set pressures. The present invention is directed to a dual action pressure switch which generally comprises an upper casing portion having a coaxial center pressure inlet, a lower casing portion secured to the upper casing portion, a diaphragm air-tightly pinched at the periphery thereof between the upper and lower casing portions to define a resilient pressure receiving chamber in the upper casing portion, a piston disposed on the side of the diaphragm opposite from the pressure receiving chamber to move vertically subjected to pressure through the diaphragm and a holder biased upwardly to engage the piston by a spring surrounding the holder and which is characterized by a pair of stationary terminals having the lower ends extending downwardly beyond the lower ends of the lower casing portion, a rod extending through the diaphragm and leaf springs through one of which the rod extends and the other of which engages the rod to thereby provide an electrical switching section.

In this way, according to the present invention, difference in operative pressure is provided between a second set pressure for turning the switch ON and OFF and a third set pressure lower than the second set pressure to thereby prevent the chattering phenomenon by which the pressure switch repeats ON and OFF conditions.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 1:
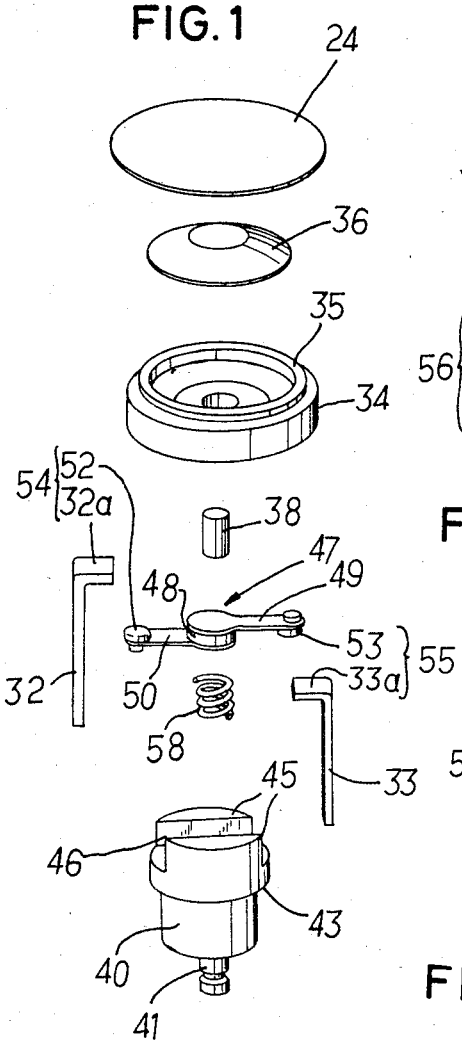
FIG. 1 is an exploded perspective view of a first embodiment of the dual action pressure switch according to the present invention.

The present invention will be now described referring to the accompanying drawings and more particularly, to FIGS. 1 through 4 thereof in which the first embodiment of the dual action pressure switch according to the present invention is illustrated. The pressure switch generally comprises a hollow body or casing which includes an upper casing portion 20 having a center coaxial pressure inlet 21 in an upper part thereof and a lower casing portion 23 against an upper part of which a lower part of the upper casing portion is caulked whereby the two casing portions are secured to each other. The periphery of a diaphragm 24 and a packing 25 are pinched and held in position between the upper and lower casing portions 20, 23. The lower part of the upper casing portion 20 has a pressure receiving chamber 22 which is defined by the diaphragm and in communication with the center pressure inlet 21. The lower casing portion 23 is formed of insulation and defines a largest diameter chamber 27 in the upper part thereof and an intermediate diameter chamber 29 is also formed in the upper part below the chamber 27 with the shoulder 28 interposed therebetween. The lower part of the lower casing portion 23 defines a smallest diameter chamber 30 which is in communication with the bottom of the intermediate diameter chamber 29 and a port 31 is formed in the lower end of the lower part of the lower casing portion in communication at the upper end with the smallest diameter chamber 30 and at the lower end with the atmosphere.

A pair of stationary terminals 32, 33 extend vertically through the lower part of the lower casing portion. The lower ends of the terminals 32, 33 extend downwardly beyond the lower end of the lower casing portion 23 and the upper ends of the terminals are bent in different heights at right angles to the rests of the associated terminals towards each other to thereby provide first and second stationary contacts 32*a*, 33*a*, respectively. A piston 34 is disposed within the largest diameter chamber 27 below the diaphragm 24 for vertical movement within the chamber 27. In addition to a first larger diameter effective pressure receiving area which is on the upper surface of the piston and varies depending upon the configuration of the periphery of the piston, that of the diaphragm and other factors, the upper surface of the piston is further formed with a second smaller diameter effective pressure receiving area defined by an annular projection 35 positioned inwardly from the periphery of the piston 34. A resilient disc 36 is disposed within and extends across the annular projection 35 for upward and downward movement under its inherent resiliency subjected to pressure. The resilient disc 36 resiliently moves by the second pressure receiving area and resiliently warps in one direction under a second set pressure $P_2$ and in the opposite direction under a third set pressure $P_3$ which is smaller than the second set pressure as will be described hereinafter. The piston 34 has an axial through opening 37 for receiving a piston rod 38 for vertical movement.

An insulating holder 40 is received within the smallest diameter chamber 30 for vertical movement therein and has downwardly extending reduced diameter bar 41 received in the port 31. A stopper ring 42 is secured to the lower end of the bar 41 to limit the upward movement distance of the holder 40. A flange 43 is provided at the upper end of the holder 40 and a pair of opposite and spaced projections 45, 45 extend uprightly from the flange 43 to define a space 46 therebetween. A first spring 44 extends between the bottom of the smallest diameter chamber 30 and the flange 43 to normally urge the holder 40 upwardly. Reference numeral 47 denotes a movable contact assembly comprising a plate 48 and a pair of leaf springs 49, 50 secured at the base ends thereof to the upper and lower surfaces of the plate 48, respectively and extending in the opposite directions from the plate in a linearly alignment with each other. A first contact 52 extends uprightly at the leading end of the leaf spring 53 and similarly, a second contact 53 extends downwardly at the leading end of the leaf spring 49. The above-mentioned first stationary contact 32*a* and the first contact 52 form a first switching section and the above-mentioned stationary contact 33*a* and the second contact 53 form a second switching section 55. The first and second switching sections 54, 55 form an electrical switching section 56. The movable contact assembly 47 is normally urged upwardly by a second spring 58 received in a recess 40*a* formed in the top of the holder 40 so that the upper surface of the movable contact assembly 47 engages the piston 34 or the lower end of the piston rod 38.

Figure 2:
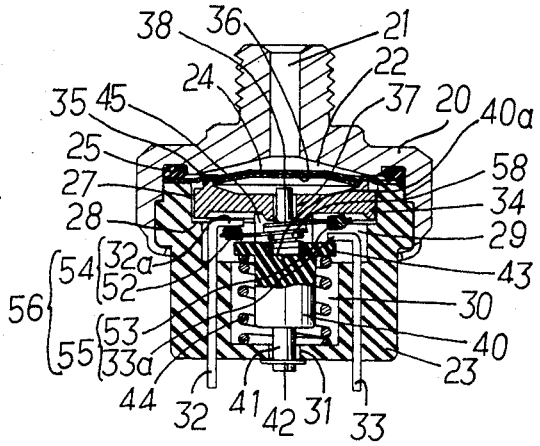
FIGS. 2, 3 and 4 are vertically sectional views of said pressure switch showing the same in different operative conditions.
Figure 3:
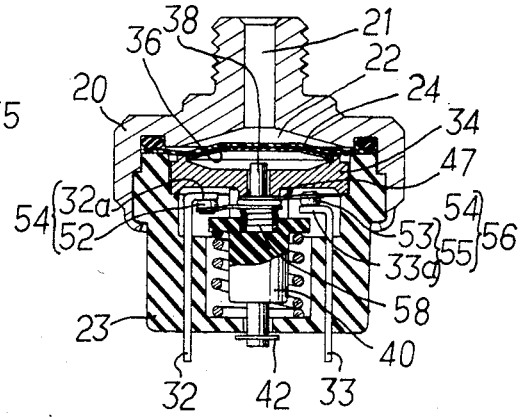
Figure 4:
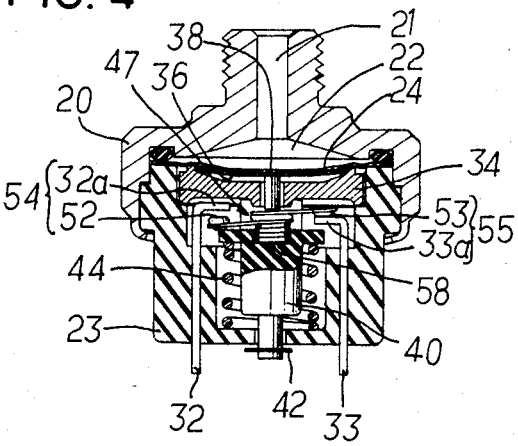
Figure 5:
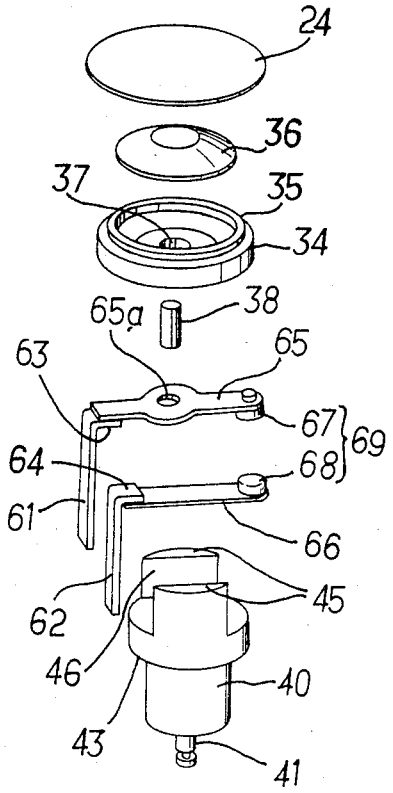
FIG. 5 is an exploded perspective view of a second embodiment of the dual action pressure switch according to the present invention.

The operation of the first embodiment of the dual action pressure switch according to the present invention will be now described referring to FIGS. 2 through 4. FIG. 2 shows when the pressure within the pressure receiving chamber 22 is at a value below the first set pressure ($P_1$). When the pressure within the pressure receiving chamber 22 is at a value below the first set pressure $P_1$, the holder 40 is biased upwardly under the force of the first spring 44 until the stopper ring 42 abuts against the lower end of the lower casing portion 23 and held in position, the piston 34 is also pushed up by the projections 45, 45 integral with the holder 40 and furthermore, the piston rod 38 is also biased upwardly under the force of the second spring 58 whereby the first stationary contact 32*a* is engaged by the first contact 52 and the second contact 53 is pushed up whereby the second switching section 55 is turned OFF resulting in the turning of the electrical switching section 56 OFF.

At this time, the force applied to the piston 34 is the power $F(K_g)$ of the effective pressure receiving area $Scm^2$ formed by the piston 34, lower casing portion 23 and diaphragm 24 by pressure $P(K_g/cm^2)$ and the power $F(K_g)$ is downwardly applied to the piston 34. On the other hand, the force $F_2(K_g)$ of the first spring 44 is transmitted through the holder 40 to the piston 34 to push the piston upwardly (the force of the second spring 58 is set substantially smaller than that of the first spring 44) whereby the piston moves as follows:

$$P \times S = F_1 < F_2 \ldots \text{upward movement of piston}$$

$$P \times S = F_4 > F_2 \ldots \text{downward movement of piston}$$

whereby the value of $P(P_1)$ in which $F_1 = F_2$ becomes the first set pressure and the piston cannot be raised at any pressure below the first set pressure.

FIG. 3 shows the operative condition of the pressure switch in which the pressure within the pressure receiving chamber 22 is at a value greater than the first set pressure ($P_1$), but smaller than the second (third) set pressure ($P_2$) and in this operative condition, the piston 34 descends down to engage the shoulder 28 on the inner surface of the lower casing portion 23 and the movable contact assembly 47 is pushed down by having the contact 53 act as the fulcrum against the force of the second spring 58. By this, the first contact 52 comes into contact with the first stationary contact 32*a* to close the first switching section 54 to thereby turn the electrical switching section 56 ON while leaving the second switching section 55 ON. FIG. 4 shows the operative condition of the pressure switch in which the pressure within the pressure receiving chamber 22 is at a value greater than the second set pressure ($P_2$) and the resilient disc 36 is resiliently warped downwardly to push the movable contact assembly 47 through the rod 38 by having the second contact 53 act as the fulcrum against the force of the first spring 44 to turn the first switching section 54 OFF to thereby turn the electrical switching section 56 OFF while leaving the second switching section 55 ON.

Figure 9:
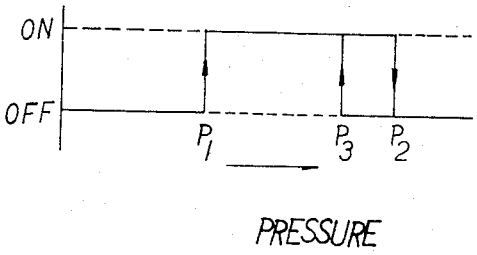
FIG. 9 is a diagram showing the relationship between set pressures and ON and OFF conditions of the switching section in the dual action pressure switch of the invention.

When the pressure P decreases from a value above the second set pressure to the third set pressure ($P_3$), the resilient disc 36 resiliently returns upwardly to the upwardly warped position as shown in FIG. 3. By repeating the above-mentioned operation procedure, the contacts can be opened and closed as shown in the diagram of FIG. 9. Since the movable contact assembly 47 is positioned in the space 46 between the upright projections 45, 45, the lateral movement of the movable contact assembly 47 is limited and as a result, the contacts 52, 53 on the movable contact assembly can positively and properly engage the first and second stationary contacts, respectively.

Referring now to FIGS. 5 through 8 in which the second embodiment of the dual action pressure switch according to the present invention is illustrated. A pair of stationary terminals 61, 62 extend vertically through the lower part of the lower casing portion 23 having the lower ends thereof projecting beyond the lower end of the casing portion and the upper ends bent in different heights at right angles to the rests of the associated contacts, respectively, to form mounting means 63, 64, respectively. First and second leaf springs 65, 66 are secured at the base ends thereof to the mounting means 63, 64, respectively and the leading ends of the springs support first and second contacts 67, 68, respectively, which are adapted to engage each other and disengage from each other and form an electrical switching section 69. The upper or first leaf spring 65 has in the center thereof a through hole 65*a* through which the rod 38 extends with the lower end of the rod resting on the second leaf spring 66 positioned below the rod.

The components of the second embodiment which are identical with or similar to the corresponding components of the first embodiment are affixed the same numerals thereto and description on the identical and similar components will be omitted herein.

Figure 6:
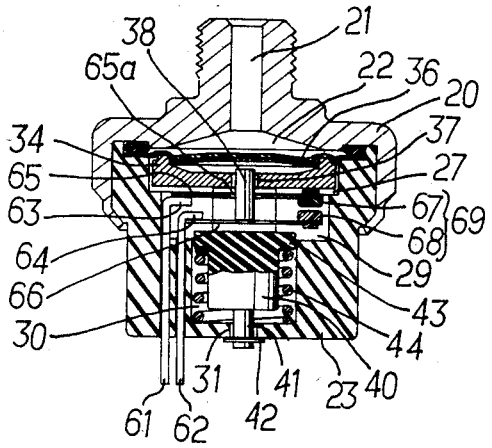
FIGS. 6, 7 and 8 are vertically sectional views of the second embodiment of the dual action pressure switch as shown in FIG. 5 showing the same in different operative conditions.
Figure 7:
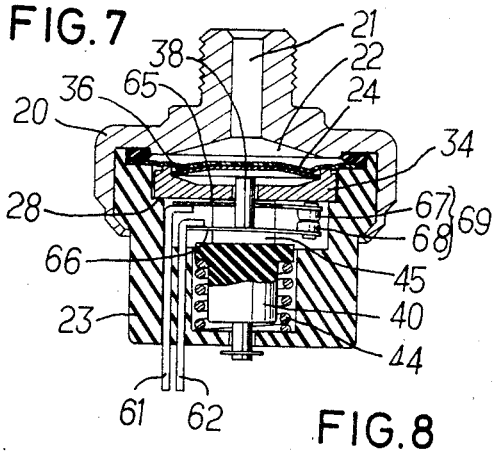

In the operation of the second embodiment, the pressure introduced into the pressure receiving chamber 22 through the pressure inlet 21 acts on the diaphragm 24 which in turn pushes the piston 34 downwardly. On the other hand, the first spring 44 pushes the piston 34 upwardly through the holder 40 against the pressure within the pressure receiving chamber 22 until the stopper ring 42 on the holder 40 abuts against the lower end of the lower casing portion 23. FIG. 6 shows when the pressure within the pressure receiving chamber 22 is at a value lower than the first set pressure ($P_1$) wherein the piston 34 is pushed up to a position above the shoulder 28 on the lower casing portion 23 and the first and second contacts 67, 68 are separated from each other to thereby turn the electrical switching section 69 OFF. FIG. 7 shows when the pressure within the pressure receiving chamber 22 is at a value greater than the first set pressure ($P_1$), but lower than the second set pressure ($P_2$), the piston 34 is pushed down to the position in which the piston abuts against the shoulder 28 and the first contact 67 is also pushed down to contact the mating contact 68. In the condition of FIG. 7, since the resilient disc 36 has not yet warped downwardly, the rod 38 remains in the position as shown in FIG. 1 and has not yet descended and as a result, the two contacts 67, 68 engage each other to thereby turn the electrical switching section 69 ON.

Figure 8:
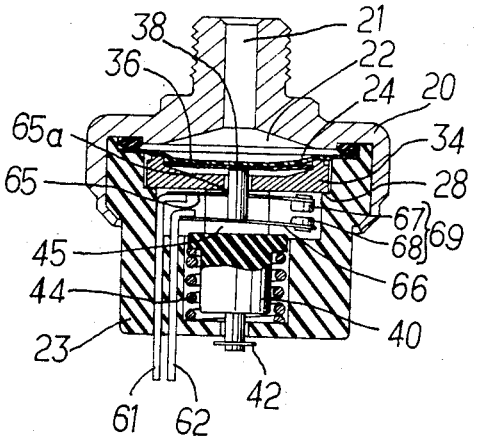

When the pressure within the pressure receiving chamber 22 is at a value below the second (third) set pressure, the resilient disc 36 warps upwardly, but when the pressure receiving chamber is at a pressure above the second set pressure the disc warps downwardly. Thereafter, when the pressure within the pressure receiving chamber 22 becomes a value below the third set pressure ($P_3$) the disc warps upwardly again. FIG. 8 shows when the pressure within the pressure receiving chamber 22 is at a value above the second set pressure and the resilient disc 36 warps downwardly to push the rod 38 downwardly to disengage the first contact 67 from the second contact 68 resulting in the turning of the electrical switching section 69 OFF. Next, when the pressure within the pressure receiving chamber 22 drops from a value above the second set pressure to a value below the third set pressure ($P_3$), the resilient disc 36 warps upwardly as mentioned hereinabove and releases its force which tends to push the rod 38 down and as a result, the second leaf spring rises to cause the contact 68 to engage the contact 67 to thereby turn the electrical switching section 69 ON. The above-mentioned procedure is repeated. In this way, the electrical switching section 69 is turned ON at the first set pressure ($P_1$) and turned OFF at the second set pressure ($P_2$). When the electrical switching section 69 is desired to be turned ON, the third set pressure ($P_3$) lower than the second set pressure ($P_2$) is provided and thus, since the difference in value exists between the second and third set pressures, the so-called chattering which repeatedly turns the electrical switching section ON and OFF at a substantially same value of pressure can be prevented.

With the above-mentioned construction and arrangement of the components of the dual action pressure switch according to the present invention, the present invention provides the following operative effects:

(1) The highest or second set pressure is set by the resilience of the resilient disc acting in one direction, the third set pressure lower than the second set pressure is set by the resilience of the disc acting in the direction opposite to the first direction and the lowest or first set pressure is set by the effective pressure receiving area and the strength of the first spring and thus, since the different set pressures are independent of each other, pressure regulation can be easily made.

(2) Since the resilient disc is resiliently warped upwardly and downwardly subjected to pressure through the diaphragm to thereby directly transmit the difference in operative pressures to the switch so as to open and close the switch, the switch has an excellent pressure response characteristic and in addition, the operation timing of the switch is precise.

(3) Since the resilient disc, the leaf springs having the contacts at the leading ends and the rod adapted to engage the leaf springs set the differential pressure response, any complicate arrangement such as snap action can be eliminated whereby the dual action switch can be produced as a compact and light weight device.

(4) Since the ON or OFF timing of the electrical switching section is provided with the differential pressure response corresponding to variation in pressure, the chattering and/or noise of the switch at the second set pressure can be prevented and the service life of the contacts can be extended.

(5) Since one spring accommodates two set pressures, the number of components can be reduced and the switch can be reduced in weight and simply assembled to thereby enhance the operation efficiency for fabricating the switch.

While only two embodiments of the invention have been described in detail, it will be understood that they are for illustration purpose only and not to be taken as a definition of the invention, reference being had for the purpose to the appended claims.

What is claimed is:

1. A dual action pressure switch comprising a casing including an upper casing portion having a center coaxial pressure inlet and a lower casing portion secured to said upper casing portion, a diaphragm pinched at the periphery between said upper and lower casing portions to define a pressure receiving chamber within said upper casing portion in communication with said inlet, a packing sealing between said upper and lower casing portions and said diaphragm, a piston disposed within said pressure receiving chamber below said diaphragm for vertical movement subjected to pressure transmitted from said chamber through said diaphragm, a holder disposed within said lower casing portion normally resiliently engaging said piston and a spring surrounding said holder to normally bias the holder upwardly so as to cause the holder to engage the piston, characterized by a pair of stationary terminals having the lower ends projecting downwardly beyond the lower end of said lower casing portion, a resilient disc disposed within said upper casing portion below said diaphragm, a rod disposed within said piston below said disc and leaf springs positioned to receive resilient force from the disc through said rod as said resilient disc resiliently warps, said stationary terminals, resilient disc, rod and leaf springs forming an electrical switching section.

2. The dual action pressure switch as set forth in claim 1, in which said leaf springs are connected together in different heights and linearly alignment and have contacts secured at one end, respectively and said stationary terminals are bent at the upper ends in different heights and have stationary contacts secured thereto in opposition to said contacts on the leaf springs.

3. The dual action pressure switch as set forth in claim 1, in which said leaf springs are secured at the rear ends to the upper ends of said pair of stationary terminals disposed in different heights and have contacts secured to the leading ends for engaging each other and disengaging from each other, the higher leaf spring being operable by said piston and the lower leaf spring being operable subjected to the resilient force transmitted from said resilient disc through said rod.

* * * * *